US006565247B2

(12) United States Patent
Thominet

(10) Patent No.: US 6,565,247 B2
(45) Date of Patent: May 20, 2003

(54) ILLUMINATION DEVICE FOR VEHICLE

(75) Inventor: Vincent Thominet, Echandens (CH)

(73) Assignee: Robert Bosch GmbH, Stuttgart (DE)

( * ) Notice: Subject to any disclaimer, the term of this patent is extended or adjusted under 35 U.S.C. 154(b) by 77 days.

(21) Appl. No.: 09/793,952

(22) Filed: Feb. 27, 2001

(65) Prior Publication Data

US 2001/0019486 A1 Sep. 6, 2001

(30) Foreign Application Priority Data

Mar. 1, 2000 (DE) ..... 100 09 782

(51) Int. Cl.[7] ..... F21S 8/10

(52) U.S. Cl. ..... 362/545; 362/231; 362/244; 362/800

(58) Field of Search ..... 362/545, 230, 362/231, 244, 800; 313/500; 257/98

(56) References Cited

U.S. PATENT DOCUMENTS 5,477,436 A * 12/1995 Bertling et al. ..... 362/231
5,570,951 A * 11/1996 Bertling et al. ..... 362/231
6,318,886 B1 * 11/2001 Stopa et al. ..... 362/555
6,367,949 B1 * 4/2002 Pederson ..... 362/240

FOREIGN PATENT DOCUMENTS

DE 42 28 895 A1 3/1994

* cited by examiner

*Primary Examiner*—Sandra O'Shea
*Assistant Examiner*—Ronald E. DelGizzi
(74) *Attorney, Agent, or Firm*—Michael J. Striker

(57) ABSTRACT

An illumination device for a vehicle has a plurality of semiconductor sources distributed in a matrix, at least one optical active element which is located in a path of rays of a light emitted by the semiconductor sources, the semiconductor sources are arranged in partial quantities in different defined partial regions of the matrix and the partial quantities of the semiconductor sources are operatable independently from one another.

9 Claims, 3 Drawing Sheets

ILLUMINATION DEVICE FOR VEHICLE

BACKGROUND OF THE INVENTION

The present invention relates to an illumination device for a vehicle.

Illumination devices for vehicles are known and widely used. One such illumination device is disclosed, for example, in the German patent document DE 42 28 895. The illumination device has a plurality of semiconductors light sources arranged in a matrix. In a path of rays of light emitted by the semiconductor light sources, an optically active element is arranged and formed as a disc. It is provided with optical profiles in macroscopic size in the form of lenses or prisms or in microscopic size in the form of a diffraction grate. The optical profiles in a macroscopic size provide a predetermined characteristic for a light beam which exits the illumination device. The semiconductor light sources emit lights of different colors and each semiconductor light source sends only light of one color. With the optical profiles in microscopic size, a mixture of the lights emitted by the different semiconductor light sources is obtained. Therefore, light exiting the illumination device has a uniform color, such as white.

This illumination device is however usable only for one function, since the light beam exiting the device always has the same characteristic. The term "characteristic" of the light beam includes here a light color, its direction, its reaching distance, dispersion width and illumination intensity distribution produced by it.

SUMMARY OF THE INVENTION

Accordingly, it is an object of the present invention to provide an illumination device for a vehicle that has the advantage that by the operation of different partial numbers of semiconductor sources, the characteristic of the light beam exiting the illumination device can be changed so that it can be used for different functions.

In accordance with another feature of present invention, with the partial numbers of the semiconductor sources arranged in different defined partial regions, light of different colors is emitted, and the partial quantities of the semiconductor light sources are operatable for producing a predetermined color of the light beam exiting the illumination device. In this construction the emission of the light beams of different light colors is possible, so that the illumination device can be used for example for different signal functions or for one signal function and as a headlight.

In accordance with another feature of the present invention, in the matrix a partial region is defined, by which semiconductor light sources produce a concentric light beam. This makes possible the use of the illumination device as a headlight with a strong illumination of a distance located far from the vehicle.

In accordance with still another feature of present invention, a partial region is defined in the matrix, by which the semiconductor light source produces a horizontally dispersed light beam. This makes possible the use of the illumination device as a headlight with a wider illumination in front of the vehicle, as is specifically advantageous at low speeds, for example in street traffic, and/or with low visibility distance, for example in fog.

In accordance with another feature of present invention, In the matrix at least one partial region is defined, by which the semiconductor light sources produce at one side a light beam oriented to the right or to the left. This allows the use of the illumination device as a headlight with a one-sided oriented illumination in front of the vehicle, which is especially advantageous when driving around a curve or when turning the vehicle.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
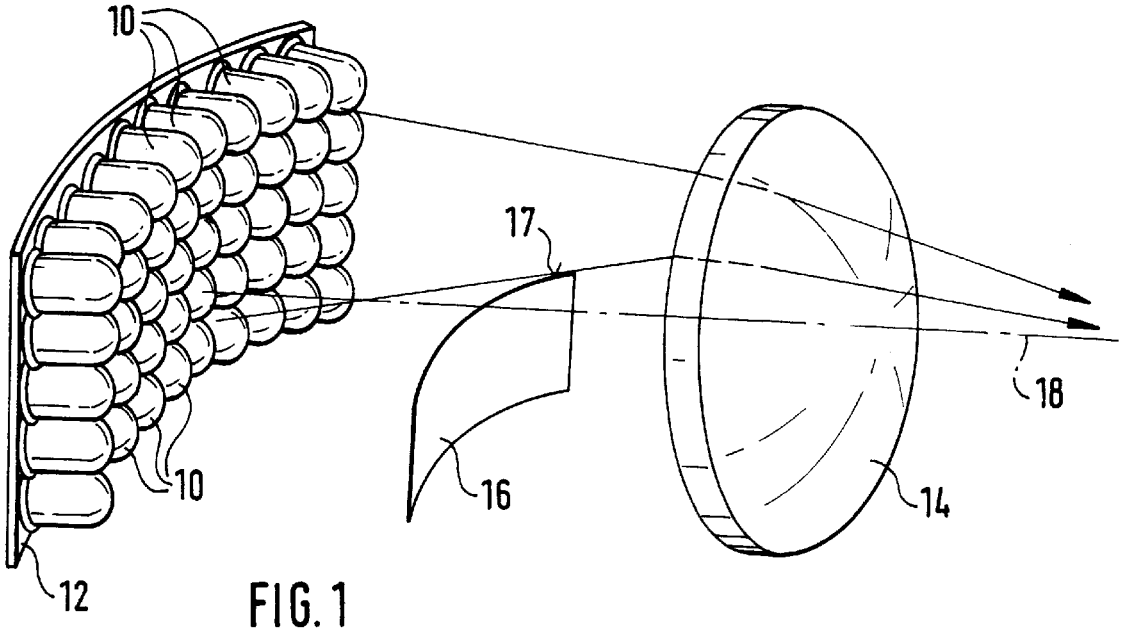
FIG. 1 is a view showing an illumination device for a vehicle in a schematic representation in accordance with the present invention.

FIG. 1 shows an illumination device for a vehicle, in particular a motor vehicle. The illumination device is arranged at the front end of the vehicle and is used, for example, as a headlight. Two substantially identically formed illumination devices can be arranged at the front end, as conventional headlights. The illumination device has a plurality of semiconductor sources 10 which are distributed in a matrix. A support element 12 can be provided, on which the semiconductor light sources 10 are held and electrically contacted.

The semiconductor light sources 10 can be arranged approximately in one plane, or can be distributed over a concavely curved surface or a stepped surface. The surface, for example, can have a substantially spherical curvature. In a path of rays of the light emitted by the semiconductor light sources, an optically active element 14 is arranged and formed as a collecting lens. The collecting lens 14 beams the light that is emitted by the semiconductor light sources 10 and passes through the collecting lens 14. Thereby it exits the illumination device with a predetermined characteristic.

A screen 16 can be arranged between the semiconductor sources 10 and the collecting lens 14. The screen screens a part of the light emitted by the semiconductor sources 10 and thereby produces a bright-dark limit of the light beam exiting the illumination device. The screen 16 is arranged substantially under an optical axis 18 of the illumination device. The position and shape of the bright-dark limit of the light beam exiting the illumination device is determined by the position and the shape of the upper edge 17 of the screen 16, which is formed by the collecting lens 14 and revised in height and laterally.

Figure 2:
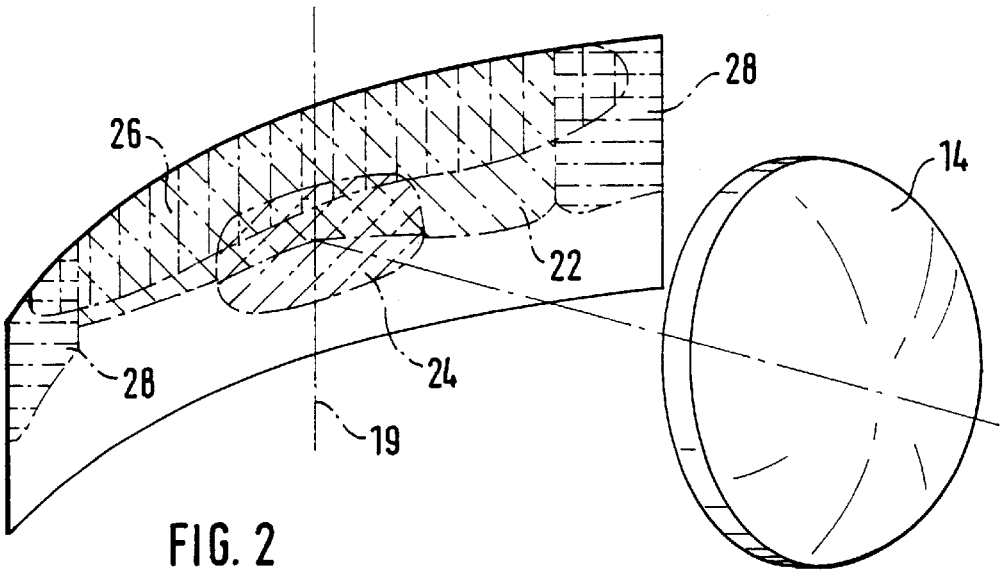
FIG. 2 is a view showing a matrix of semiconductor light sources of the illumination device in accordance with the first embodiment of the present invention.

With the use of the illumination device only as a headlight, preferably the semiconductor light sources 10 are utilized, which all emit at least approximately white light. The matrix of the semiconductor light sources 10 in accordance with the first embodiment is shown in FIG. 2. Predetermined partial regions are defined on the matrix, in which partial numbers of the semiconductor light sources 10 are arranged. The semiconductor light sources 10 arranged in the different partial regions are actuatable independently from the semiconductor sources 10 arranged in the remaining partial regions. It can be provided that the semiconductor sources 10 of each partial region are jointy contacted or semiconductor light sources of at least one region which is further subdivided in a partial region are jointly contacted, so that they must not be controlled individually for the operation.

A first partial region 22 with a partial quantity of the semiconductor sources 10 is defined on the matrix. It extends downwardly starting from an upper edge of the matrix and is arranged substantially symmetrically at both sides of a vertical central plane 19 of the matrix. In a horizontal direction, the partial region 22 extends not completely to the lateral edges of the matrix. The lower edge of the partial region 22 can have, for example, the shape of the bright-dark limit, which must be provided for the light beam exiting the illumination device. In this case, the screen 18 is dispensed with. The lower edge of the partial region 22 can have any other arbitrary form, when the screen 18 is provided for producing the bright-dark limit. When the semiconductor light sources 10 of the pressure region 22 are operated, the light emitted by them produces an asymmetrical low beam that exits the illumination device.

Figure 4:
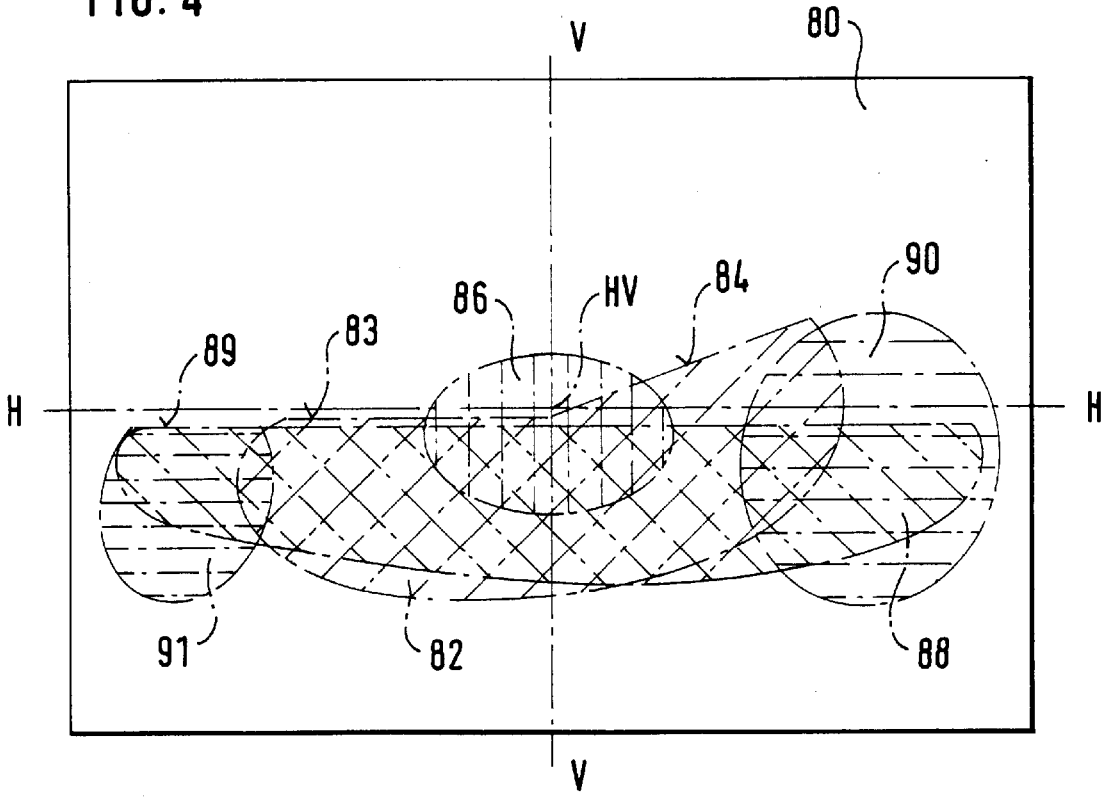
FIG. 4 is a view showing a measuring screen arranged in front of the illumination device in accordance with the present invention and illuminated by light emitted by the latter.

FIG. 4 shows a measuring screen 80, which is arranged at a distance from the illumination device. It represents a projection of a roadway located in front of the illumination device and correspondingly illuminated. The measuring screen 80 has a vertical central plane identified as VV and a horizontal central plane identified as HH. They intersect in a point HV. The light emitted by the semiconductor sources 10 and exiting the illumination device, illuminates the measuring screen 80 in a region 82 which is limited from above by an asymmetrical bright-dark limit 83, 84. The bright-dark limit has a horizontal portion 83, for example at the side counter to traffic (that is, a left side of the measuring screen 80 in the case of a right traffic). At the traffic side itself, which is a right side of the measuring screen 80 in the case of a right traffic, it has a portion 84, which rises starting from the portion 83.

A second partial region 24 with a partial quantity of the semiconductor sources 10 is defined in the matrix. When compared with the partial region 22, it has a smaller size. The partial region 24 is arranged substantially in the center of the matrix and extends upwardly, not to the edge of the matrix, and extends downwardly further than the partial region 22. When the semiconductor sources 10 of the partial region 24 are operated, the light emitted by them is produced as a concentric light beam that exits the illumination device. The concentric light beam illuminates the region 86 on a measuring screen 80, which has a smaller expansion when compared with the region 82 and partially extends outwardly beyond the bright-dark limit 83, 84 of the region 82. With the concentric light beam, first of all the far region in front of the vehicle is illuminated. The semiconductor light sources 10 of the partial region 24 can be operated, for example, for producing a high beam or for improving the illumination of the far region in front of the vehicle at high speeds.

A third partial region 26 can be defined by the partial quantity of the semiconductor sources on the matrix. It has a smaller extension in a vertical direction than the partial region 22, but a greater extension in a horizontal direction. The partial region 26 can extend over the total width of the matrix. The partial region 26 extends from the upper edge of the matrix downwardly and ends, however, at a distance from the lower edge of the partial region 22. The lower edge of the partial region 24 can extend substantially horizontally. When the semiconductor sources 10 of the partial region 26 are operated, then the light emitted by them produces the horizontally dispersed light beam, which exits the illumination device. With the horizontally dispersed light beam, a region 88 of the measuring screen 80 is illuminated. It has a greater extension in a horizontal direction than the region 82, however a smaller extension in a vertical direction. The region 88 is limited upwardly by a substantially horizontal bright-dark limit 89 that extends under the bright-dark limit 83, 84 of the region 82. The semiconductor sources 10 of the partial region 26 can be operated, for example, in the case of low sight distance, such as for example in fog, or in the case of low speeds.

A fourth partial region 28 with a partial quantity of the semiconductor light sources 10 can be defined on the matrx. It is located near the lateral edges of the matrix. The fourth partial region 28 has a substantially smaller extension in a horizontal direction than the first partial region 22 and an extension in a vertical direction that is substantially equal to that of the partial region 22. The fourth partial region 28 extends between the first partial region 22 and the lateral edges of the matrix. When the semiconductor sources 10 of the fourth partial region 28 are operated, then the light emitted by them produces a one-side oriented light beam that exits the illumination device. The fourth partial region 28 that is left, as considered from the semiconductor sources 10 in the light outlet direction, illuminates a region 90 of the measuring screen 80 that is arranged at the right of the region 82. The fourth partial region 28, which is right from the semiconductor light sources 10, as considered in the light outlet direction, illuminates a region 91 of the measuring screen 80 that is arranged at the left of the region 82. The semiconductor sources 10 of one of the fourth partial regions 28 are preferably operated when the vehicle drives over a curve or during a bending process. The semiconductor light sources 10 of the partial region 28 are operated so that the light emitted by each of them provides an illumination in the corresponding traveling direction. It can be also provided that the semiconductor light sources 10 of both fourth partial regions 28 are operated. This can be advantageous for example at low speeds of the vehicle, to ensure illumination in front of the vehicle over a great width.

By operation of the light sources 10 of the corresponding partial region 22, 24, 26, 28 in a simple manner it is possible to switch over between the above mentioned different light functions. Such a switchover can be performed manually by the vehicle driver or automatically by a control device depending on the operational parameters of the vehicle, such as for example the speed and/or the steering wheel action and/or depending on other parameters such as for example the wiper and/or sensor system, such as for example for recognizing a counter traffic. The switching over of the operation of the semiconductor sources 10 of the partial region 22, 24, 26, 28 to the operation of the semiconductor light sources of another partial region can be performed with continuous or abrupt transition.

Figure 3:
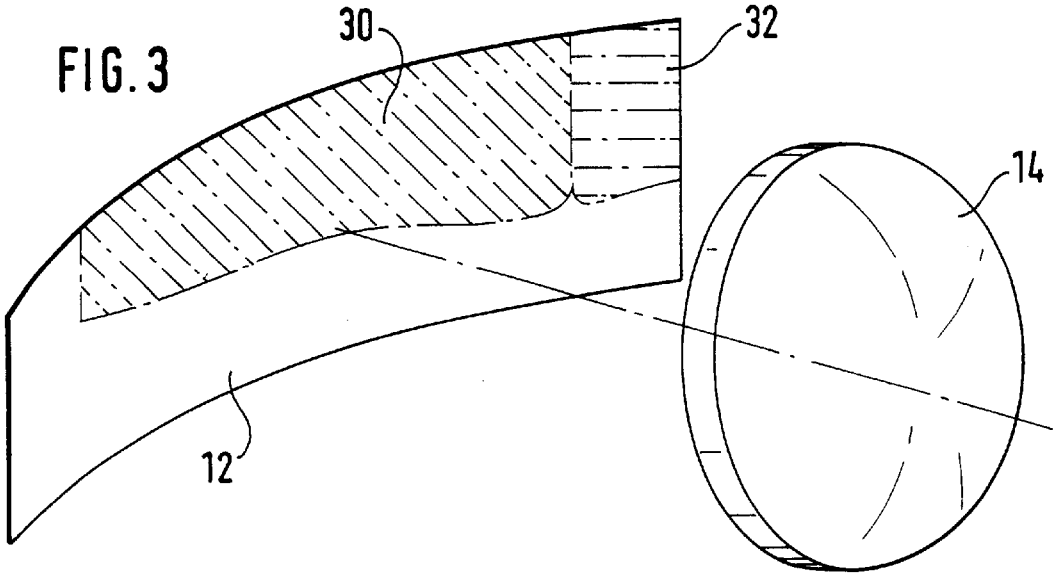
FIG. 3 is a view showing a matrix of semiconductor light sources in accordance with the second embodiment of the present invention.

In accordance with a second embodiment of the invention, which is shown in FIG. 3, partial regions with partial quantities of the semiconductor sources 10 are defined on the matrix, and the semiconductor sources 10 of the different partial regions emit light of different colors, but the light color of the semiconductor sources 10 of one partial region is uniform. It can be for example provided that in a partial region 30 of the matrix, the semiconductor sources 10 are arranged which emit at least approximately white light. The partial region 30 can take the greater part of the matrix. In a partial region 32 the semiconductor sources 10 can be arranged which emit the colored light, for example, at least approximately orange-colored light. The illumination device can be in this case used as a headlight by operating the semiconductor sources 10 of the partial region 30, and for example as a blinking light by operating the semiconductor sources 10 in the partial region 32.

Light diodes can be used as semiconductor sources 10, and they emit a visible radiation when current flows through them. Moreover, laser diodes can be also utilized, which provide the direct conversion of electrical energy into laser light. It can be provided that the semiconductor sources 10 can have each a chip for a light generation which emits the light of a predetermined color. Alternatively it can be provided that the semiconductor sources 10 have several, for example, three chips, which emit the light of different colors, and a semiconductor providing a mixture of the colors, so that it emits jointly at least approximately white light. It can be also provided that one chip emits red light, one chip emits green light, and one chip emits blue light.

Figure 5:
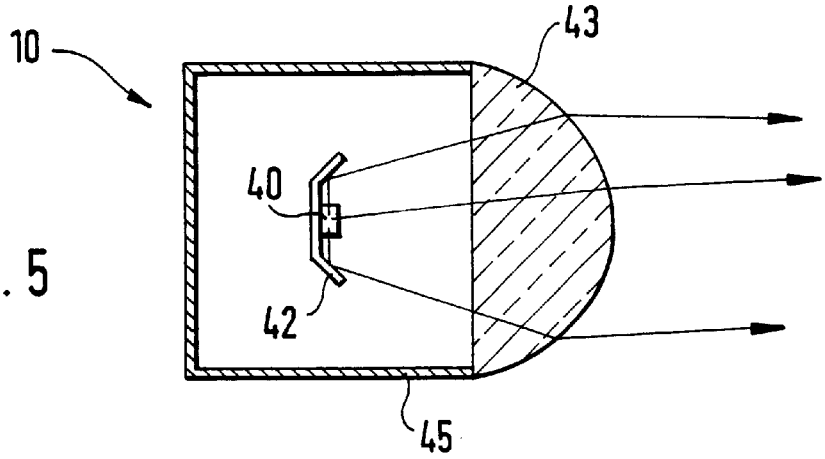
FIG. 5 is a view showing a semiconductor source in accordance with a first embodiment of the present invention.

In FIG. 5 the semiconductor source 10 in accordance with the first embodiment is illustrated. It is provided with one or several chips 40. The chips 40 are surrounded by the reflector 42, so that light from the chips 40 is reflected by the reflector. An optical element 43 formed as a lens with a spherical or a spherical curvature is arranged in the path of rays of the light which is emitted by the chips 40 and reflected by the reflector 42. The light emitted by the chips 40 is reflected by the reflector 42, collected by the lens 43 and oriented at least approximately parallel. The lens 43 can also provide a mixture of the colors of the lights emitted by the chips 40, so that at least approximately a white light is emitted by the semiconductor light source 10. The lens 42 can be composed for example as a synthetic plastic and formed on a covering which surrounds the chip 40 and the reflector 42.

Figure 6:
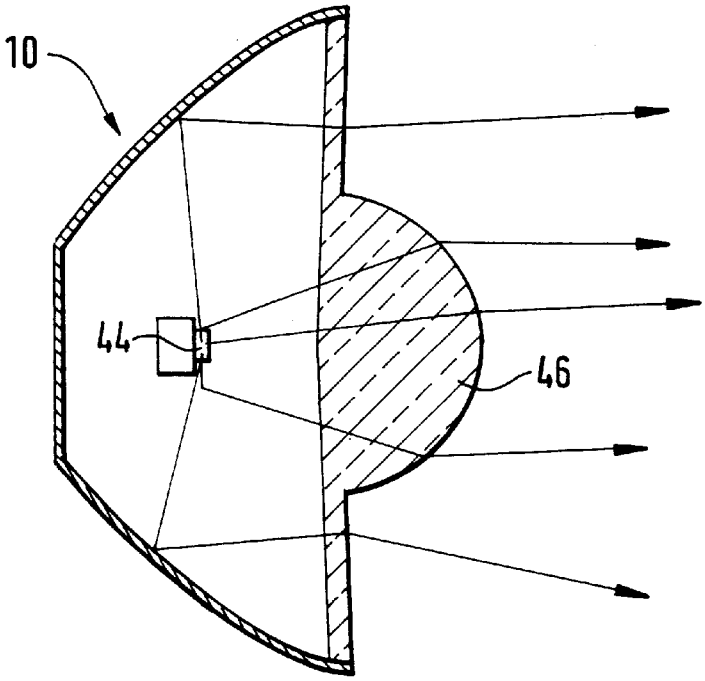
FIG. 6 is a view showing a semiconductor source in accordance with the second embodiment of the present invention.

FIG. 6 shows a semiconductor source 10 in accordance with a second embodiment of the invention. Here, also one of several chips 44 is used for producing light. The chips 44 are surrounded by a casing 45, which on the rear side of the semiconductor sources 10 is formed to be totally reflecting on the inner side. Therefore, the light emitted by them from the chips 44 is reflected, passes through one or several lenses 46 formed on the front side of the semiconductor source 10, and therefore is collected.

Figure 7:
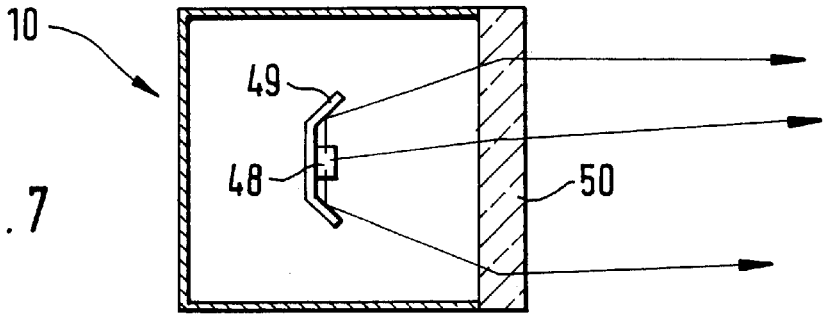
FIG. 7 is a view showing a semiconductor source in accordance with a third embodiment.

FIG. 7 shows a semiconductor source 10 in accordance with the second embodiment of the invention. Here again, one of several chips 48 are provided and surrounded by a reflector 49. Therefore the light emitted by the chip 48 is reflected by the reflector. An optical element 50 is arranged in the path of rays of the light emitted by the chip 48 and reflected by the reflector 49. It has at least one diffraction-optical structure which deviates the passing light. Preferably, the optical element 50 has three diffraction-optical structures in correspondence with the number and the light color of the chip 48. They are formed in one layer or over different layers of the element 50. Each structure is determined in accordance with a light color, so that light of this light color is deviated in a definite manner by the structure. The diffraction-optical structures of the optical element 50 are formed, for example a diffraction grater. They can be applied for example as a holographic interference pattern by a photographic or photo-lithographic method.

It will be understood that each of the elements described above, or two or more together, may also find a useful application in other types of constructions differing from the types described above.

While the invention has been illustrated and described as embodied in illumination device for vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An illumination device for a vehicle, comprising a plurality of semiconductor sources distributed in a matrix; at least one optical active element which is located in a path of rays of a light emitted by said semiconductor sources, wherein said semiconductor sources are arranged in partial quantities in different defined partial regions of said matrix and said partial quantities of said semiconductor sources are operatable independently from one another, wherein said at least one optical active element is a collecting lens.

2. A front headlight as defined in claim 1, wherein said partial quantities of said semiconductor sources arranged in said different definite partial regions are formed so that they emit lights of different colors, said partial quantities of said semiconductor sources are operatable for producing a predetermined color of a light beam exiting the front headlight.

3. An illumination device as defined in claim 1, wherein at least one of said partial regions of said matrix is formed so that said semiconductor courses of said at least one partial region produce an asymmetrical low beam.

4. A front headlight as defined in claim 1, wherein at least one of said partial regions of said matrix is formed so that said semiconductor sources of said at least one partial region produce a concentrated light beam.

5. A front headlight as defined in claim 1, wherein at least one of said partial regions of said matrix is formed so that said semiconductor light sources of said at least one partial region produce a horizontally dispersed light beam.

6. An illumination device as defined in claim 1, wherein at least one partial region of said matrix is formed so that said semiconductor sources of said at least one partial region produce a single-sided light beam at an end side oriented to the right or to the left.

7. A front headlight as defined in claim 1, wherein said semiconductor sources of said matrix are arranged in a distributed way over a concavely curved surface.

8. A front headlight as defined in claim 1; and further comprising a screen arranged between said semiconductor sources and said at least one optically active element and operative for producing a bright-dark limit of a light beam exiting the front headlight.

9. A front headlight as defined in claim 1, wherein said partial regions are formed so that a switching over of an operation of partial quantities of semiconductor sources of one of said regions to the operation of partial quantities of said semiconductor sources of another of said region is performed in a continuous transition.

* * * * *